US005490813A

United States Patent [19]

Danielsen et al.

[11] Patent Number: 5,490,813

[45] Date of Patent: Feb. 13, 1996

[54] AIR INJECTION TUBE AND A METHOD FOR AIR INJECTION

[75] Inventors: Frede Danielsen, Vejen; Carsten Jespersen, Aalborg, both of Denmark

[73] Assignee: KE-Burgmann A/S, Vejen, Denmark

[21] Appl. No.: 256,738

[22] PCT Filed: Feb. 2, 1993

[86] PCT No.: PCT/DK93/00037

§ 371 Date: Aug. 3, 1994

§ 102(e) Date: Aug. 3, 1994

[87] PCT Pub. No.: WO93/15366

PCT Pub. Date: Aug. 5, 1993

[30] Foreign Application Priority Data

Feb. 3, 1992 [DK] Denmark ..... 127/92

[51] Int. Cl.[6] ..... F24F 13/06

[52] U.S. Cl. ..... 454/306; 454/296

[58] Field of Search ..... 454/284, 292, 454/296, 306

[56] References Cited

U.S. PATENT DOCUMENTS

| | | | |
|---|---|---|---|
| 689,739 | 12/1901 | Morill | 454/306 |
| 2,423,241 | 7/1947 | Kurth et al. | 454/306 |
| 3,357,088 | 12/1967 | Hoffman et al. | 454/306 X |
| 3,719,136 | 3/1973 | Criddle | 454/306 X |
| 4,441,402 | 4/1984 | Harris | 454/306 |
| 5,111,739 | 5/1992 | Hall | 454/306 |

FOREIGN PATENT DOCUMENTS

| | | | |
|---|---|---|---|
| 67312 | 12/1914 | Austria | 454/306 |
| 1327664 | 4/1963 | France | 454/306 |
| 1956659 | 6/1970 | Germany | 454/306 |
| 86/00123 | 1/1986 | WIPO | 454/306 |

*Primary Examiner*—Harold Joyce

*Attorney, Agent, or Firm*—Dennison, Meserole, Pollack & Scheiner

[57] ABSTRACT

An air injection tube for injecting ventilating, cooling and/or heating air for installation in a room where the tube has a plurality of small, mutually spaced air injecting openings defined in its peripheral wall along longitudinally extending wall zones of the tube. The air injection openings are arranged in a plurality of groups or patterns each comprising two or more peripherally spaced rows of openings which are mutually spaced along the length of the zone and the longitudinal spacing of adjacent groups or patterns substantially exceeds the mutual longitudinal spacing of the openings in each group or pattern of openings.

38 Claims, 2 Drawing Sheets

AIR INJECTION TUBE AND A METHOD FOR AIR INJECTION

Figure 1:
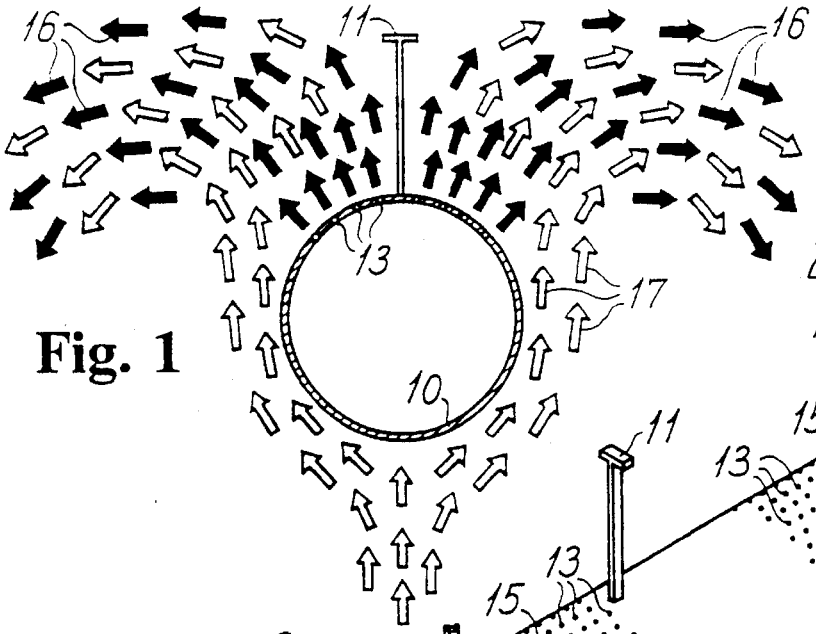

The present invention relates to an air injection tube for injecting ventilating, cooling and/or heating air into a room in which the tube is installed. Such tubes, which may be made from an air-impervious, flexible material, comprise a great plurality of uniformly mutually spaced small openings defined in a peripheral zone extending along the length of the tube.

Tubes of this known type may be used for blowing fresh and/or heated air into a large room or hall, such as factory buildings, gymnasiums, etc.

An air injection tube of this type may, for example, be mounted in the upper part of the room or hall so that the air injection openings are directed upwardly and/or sidewise. For special applications the openings may also be directed downwardly. When ventilating and/or heating air is fed into the tube at a certain pressure above that of the atmosphere a high-velocity flow of primary air is directed outwardly through each of the air injection openings of the tube. Each such high-velocity air flow generates a surrounding zone with a subatmospheric pressure, which in turn induces an inflow of secondary air from the room towards the injection tube. The velocity of the primary air flows is reduced in response to the inflow of secondary air from the room in which the injection tube is installed.

GB-A-846,472 and GB-A-929,285 disclose an injection tube or air duct of the above type, wherein the openings defined in the tube are arranged in a pair of diametrically opposite rows. The tube may be divided into axial sections, and the mutual spacing of the openings in each row of openings may be smaller in sections adjacent to a closed end of the tube than in sections adjacent to an air inlet end of the tube. SE-B-212099 discloses an air injection tube which has a square cross-sectional shape and is located at and extends along a corner between the ceiling and an adjacent side wall of a room. This known air injection tube has a plurality of small, mutually spaced air injection openings which are arranged in longitudinally spaced groups or patterns. A longitudinally extending, slot-like air injection opening is positioned between each adjacent pair of groups of openings. Air is injected into the room through the groups of openings at a relatively low flow rate while the air injected through the slot-like openings has a substantially higher flow rate.

It is desired to obtain the best possible mixing of the injected primary air with the air present in the room without inducing uncomfortable draught therein.

The mixing of the primary air supplied through the injection tube and the air present in the room may be improved by increasing the pressure of the primary air supplied to the injection tube and, consequently, also the velocity of the primary air flows. However, this in turn increases the uncomfortable draught in the room.

The present invention provides an injection tube of the above type by means of which the mixing of primary air supplied through the injection tube may be substantially improved without increasing the uncomfortable draught in the room in which the injection tube is installed.

Thus, the present invention provides an air injection tube for injecting ventilating and/or heating air into a room in which the tube is installed, a plurality of small, mutually spaced air injecting openings being defined in the peripheral wall of the tube along at least one longitudinally extending wall zone of the tube and being arranged in at least two peripherally spaced rows of openings and in groups or patterns, which are mutually spaced along the length of the zone, the longitudinal spacing of adjacent groups or patterns substantially exceeding the mutual longitudinal spacing of the openings in each group or pattern of openings, and the injection tube according to the invention is characterized in that the tube wall zone in which the air injection openings are defined has a cross-sectional shape defining an arc of a circle, that the maximum angular spacing of the air injection openings in peripherally adjacent rows of each group or pattern of openings is 45°, and in that the groups or patterns of air injection openings are spaced from the wall surfaces defining the room, whereby primary air flows exiting through the air injection openings of the axially spaced groups or patterns of openings induce a substantial increase in secondary flows of room air directed towards the air injection tube.

It has been found that the flows of secondary room air directed towards the air injection tube and induced by the primary air flows through the axially spaced groups or patterns of air injection openings are substantially increased compared with an air injection tube, in which the air injection openings are not arranged in such axially spaced groups or patterns. It is believed that the increase in the secondary air flow is obtained because the axial spacing of the groups or patterns of injection openings induces a three dimensional secondary air flow rather than the two dimensional secondary air flow—in planes at right angle to the longitudinal axis of the air injection tube—induced when the known air injection tubes are used.

The increased volume of secondary air flowing to the air injection tube according to the invention causes a substantial reduction of the velocity of the primary air flowing outwardly from the tube through the air injection openings therein. This means that the velocity of the primary air flowing out through the openings in the tube may be relatively high so that an increased inflow of secondary air may be induced without increasing the risk of uncomfortable air flow or draught in the lower part of the room, where persons are sitting or moving around.

The maximum mutual peripheral and axial spacings of the openings in each group or pattern are dependent on the velocity of the primary air flowing out through the openings defined in the tube, and, consequently, on the pressure of the air supplied to the inner space of the tube. Generally speaking, the mutual spacings of the openings should be such that the flows of primary air from all of the openings in a group or pattern of openings and the flows of secondary air induced are united so as to form a single, combined and coherent, expanding air flow close to the outer surface of the air injection tube. The combined air flows from adjacent groups or patterns of openings are also eventually united to a coherent air flow, but in a greater distance from the air injection tube, said distance being dependent i.a. on the mutual longitudinal spacings of the groups or patterns of openings.

The maximum peripheral spacing of adjacent rows of openings in each group or pattern depends not only on the velocity of the primary air flows, but also on the outer diameter of the injection tube. Normally, this peripheral spacing of peripherally adjacent rows of openings does not exceed 120 mm, and the angular spacing of such adjacent rows of openings in each group or pattern does not exceed 35°.

If the rows of openings are too closely spaced, the inflow of secondary air may be disadvantageously reduced. Therefore, the minimum peripheral spacing of the centres of a pair of openings in peripherally adjacent rows is preferably 10 mm.

Normally, it is desired to direct the primary air flows from the groups or patterns of openings in a more or less fixed direction in order to create a desired flow pattern within the room in which the injection tube is arranged. Therefore, the peripheral or angular extension of each group or pattern of openings does normally not exceed 180°. Also, when such groups or patterns of openings are arranged in two or more longitudinally co-extending zones, the combined peripheral extension of the groups or patterns does preferably not exceed 180°. On the other hand, the peripheral extension of each group or pattern of openings should preferably not be less than a certain minimum of 32 mm and preferably 64 mm.

Each of the said wall zones of the air injection tube, in which the injection openings are defined, may extend in a spiral-like manner along the air injection tube or be defined between axially extending curves of any other shape. In the preferred embodiment, however, each of these wall zones is defined between a pair of peripherally spaced generatrices of the outer tube wall surface. This means, that each of the said wall zones may be defined between a pair of angularly spaced planes extending through the longitudinal axis of the air injection tube.

The air injection openings of each group or pattern may have different mutual spacings. However, the air injection openings of each group or pattern are preferably substantially uniformly mutually spaced not only axially, but also peripherally, and the mutual spacing of the injection openings is preferably also substantially the same in the various groups or patterns.

Each pattern or group may comprise any suitable number of peripherally spaced, axially extending rows of openings. However, each group or pattern should preferably comprise at least four such rows of openings.

In order to obtain primary air flows with a relatively high velocity the air injection openings should be relatively small. Each opening may, of course, have any polygonal or other suitable shape. The air injection openings are, however, preferably substantially circular with a diameter of 2–10 mm, preferably 4–5 mm.

The axial spacing of the centers of adjacent air injection openings in each pattern or group is normally 10–50 mm and preferably approximately 20 mm. The peripheral spacing of the air injection openings in a group or pattern may be dependent i.a. on the diameter of the air injection tube.

The axial extension of each group or pattern of openings may depend on the diameter and on the axial length of the air injection tube. Normally, however, such axial extension is 200–1000 mm and preferably 500–800 mm or 400–800 mm.

The mutual longitudinal spacing of adjacent groups or patterns of openings may be adapted to the architectural conditions of the room in which the air injection tube is installed. As an example, a group or pattern of air injection openings should preferably not be positioned immediately opposite to an adjacent beam column, or wall part. However, in order to obtain substantially uniform flow conditions in the room the mutual spacing of adjacent groups or patterns of openings is preferably substantially the same along the length of the tube.

The area of each group or pattern may have any suitable outline or shape, such as circular, elliptical, or polygonal. In the preferred embodiment, however, each group or pattern of openings is defined between a pair of peripherally spaced generatrices of the tube wall and a pair of axially spaced planes extending substantially at right angles to the tube axis, so that such group or pattern has a substantially rectangular shape when the tube wall is in an unfolded plane condition.

As mentioned above, the axial spacing of adjacent groups or patterns of openings is preferably substantially uniform along the length of the tube, but the axial spacing may be different due to special circumstances. Normally, the axial spacing of adjacent groups or patterns of openings is 20–150 percent of the axial extension of each group or pattern of openings.

The tube wall may be made from a stiff, self-supporting material, but is preferably made from an air-impervious, flexible material. Thus, the peripheral wall of the injection tube may be made from glass fiber or other organic or inorganic fibers, which may be knitted, woven or non woven and covered by a plastic material or another material making the walls air-impervious.

The wall thickness of the air injection tube may be 0.2–1 mm and preferably about 0.6 mm. The diameter of the tube may, for example, be 200–2000 mm, and the length of the tube may correspond to the length of the room or hall in which it is installed and may, for example, be up to 100 m or even more. Air is supplied to the injection tube at such a superatmospheric pressure that the injection tube will be maintained in a distended condition.

The injection tube may be provided with a filtering member for filtering air supplied to the air injection tube. Such a filtering member may, for example, be arranged at the air inlet of the air injection tube, or a filtering medium may be positioned on the inner side of the air injection tube so as to cover the air injection openings. As an example, the filtering member may comprise an inner tube made from a filtering medium and arranged within the air injection tube. Dust and microorganisms may then be filtered from the fresh air or heating air flowing into the room through the injection openings defined in the injection tube.

According to a further aspect the present invention provides a method of injecting ventilating, cooling, and/or heating air into a room by means of an air injection tube according to the invention described above installed in the room, said method comprising supplying air to the inner space of the tube at a pressure so as to cause air to flow through the air injecting openings defined in the wall of the tube at a velocity of 6–15 or 8–15 m/sec, preferably 10–15 m/sec. The high velocity of the flows of primary air causes a substantially increased injector effect, which in turn causes a substantially increased three-dimensional inflow of secondary air. The large inflow of secondary air rapidly reduces the high velocity of the primary air flows while primary and secondary air is thoroughly intermixed. The groups or patterns of openings in the injection tube are orientated so that the injected primary air does not come into the lower part of the room where animals or human beings are present, until primary and secondary air has been thoroughly mixed, and the flow velocity of the intermixed air has been reduced to an acceptable degree.

In order to obtain the above mentioned high velocity of the flows of primary air an air pressure of 60–200 Pa, preferably 80–160 Pa may be maintained in the inner space of the tube. More preferably, the pressure in the inner space of the tube may be 60–120 Pa.

The flows of primary air from the injection openings are preferably directed upwardly in the room so that a thorough intermixing of primary and secondary air is obtained before the primary air enters into the lower part of the room at a substantially reduced velocity. Other desired flow patterns may be obtained by directing the primary air flows obliquely downwardly into the room.

It is understood that almost any desired flow pattern may be obtained in a specific room by properly selecting parameters, such as the diameter of injection openings, the tube diameter, the number of axially extending rows of openings in each group of openings, the peripheral mutual spacing of such rows of openings, the number of openings in each axial row of openings, the mutual axial spacing of the openings in such rows, the mutual axial spacing of axially adjacent groups or patterns of openings, the number of peripherally spaced groups or patterns of openings, the peripheral spacing of such groups or patterns of openings, and the air pressure maintained within the inner space of the injection tube.

Figure 2:
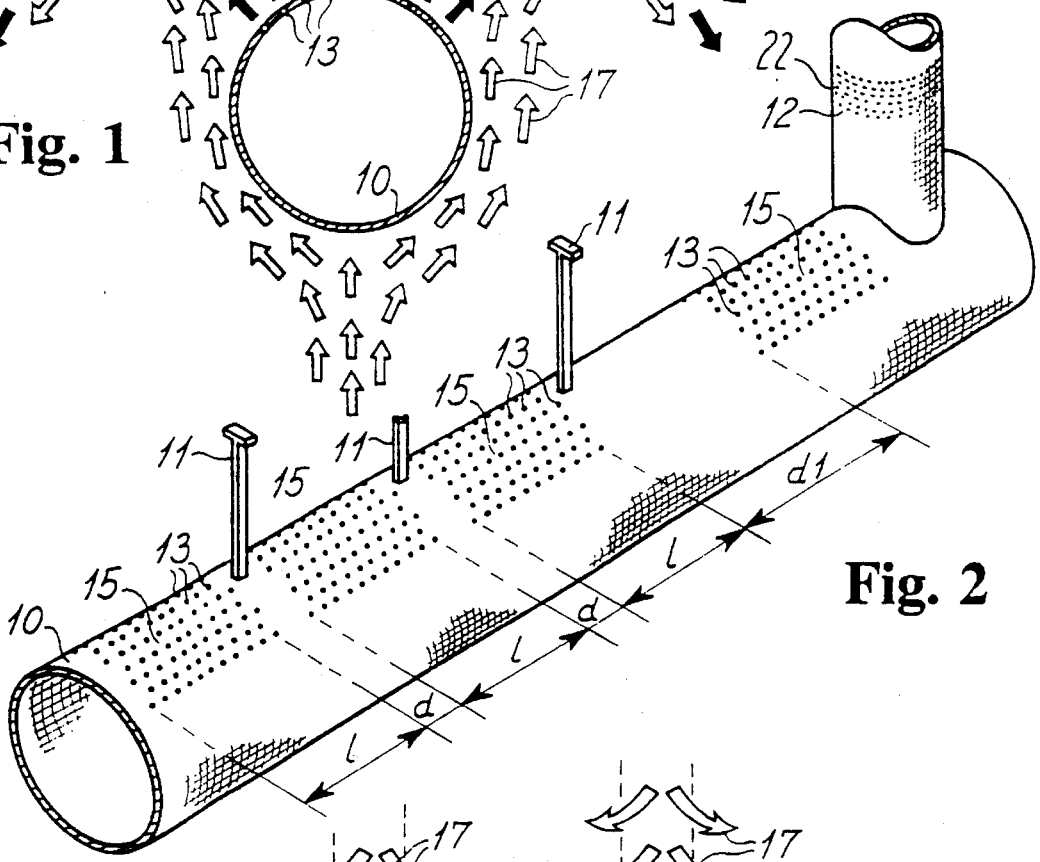
Figure 3:
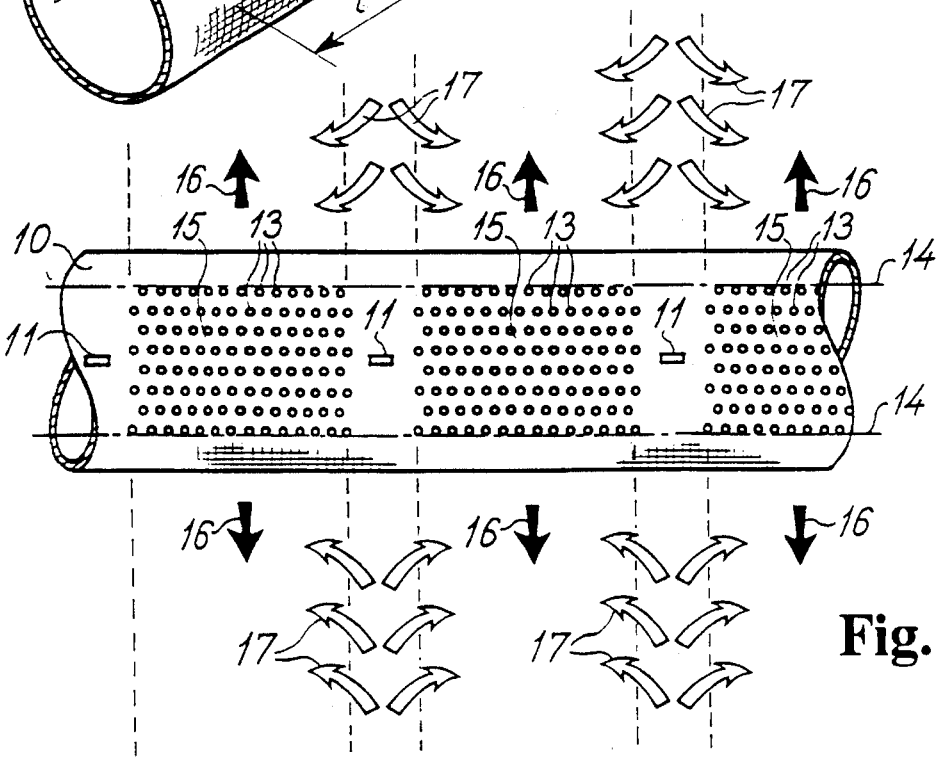

The invention will now be further described with reference to the drawings, wherein FIG. 1 is a cross-sectional view of an air injection tube according to the invention, wherein the air flow around the tube is illustrated, FIG. 2 is a perspective view of part of an embodiment of the air injection tube according to the invention, FIG. 3 is a top plane view of part of the tube shown in FIG. 2, and FIGS. 4–6 diagrammatically illustrate three different injection patterns for primary air.

An air injection tube 10, which is made from a flexible, air-impervious material, may be mounted in a large room or hall, so that the tube extends substantially horizontally through the room. The air injection tube 10 may, for example, be suspended from a roof structure or ceiling by means of suspension members 11, and ventilating and/or heating air may be supplied to the inner space of the tube 10 through an air supply conduit 12.

Figure 5:
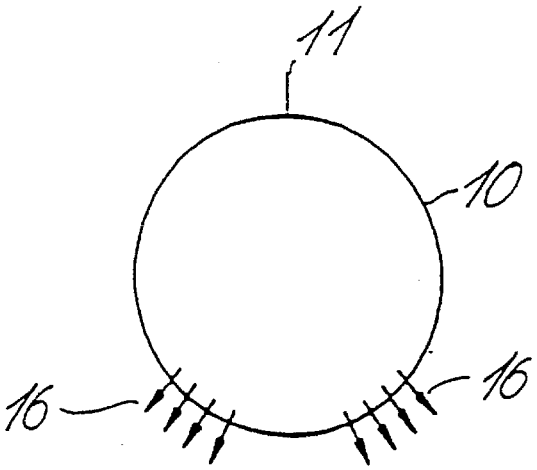
Figure 6:
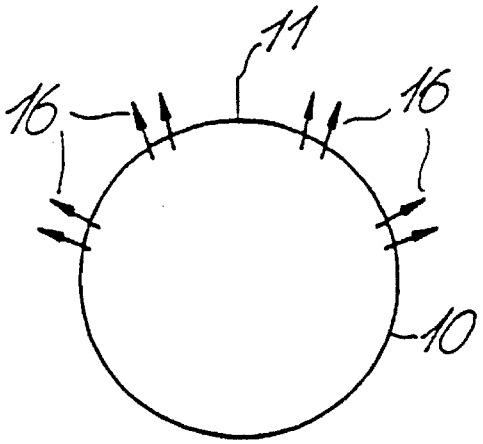

A great plurality of small openings 13 are punched in the wall of the tube 10 in a longitudinally extending zone, which is limited by a pair of spaced generatrices 14 of the tube wall (FIG. 3). The tube 10 shown in the drawings comprises only one such perforated zone, which is upwardly directed. Alternatively, the tube 10 may comprise two or more peripherally spaced perforated zones, which may, for example, be directed laterally in opposite directions as illustrated in FIGS. 5 and 6.

The air injection openings 13 are arranged in longitudinally spaced groups or patterns 15. Each group or pattern comprises preferably at least four peripherally spaced, axially extending rows of openings, and the axial dimension or length l of each pattern is preferably 500–800 mm. The mutual spacing or the axial distance d between adjacent groups or patterns 15 is preferably ⅓l–1½l. The mutual spacing d of the adjacent groups or patterns 15 of injection openings 13 is preferably substantially the same along the length of the injection tube 10. However, as illustrated in FIG. 2, the mutual spacing d1 may be increased an one or more locations, for example to avoid that a group of openings is positioned immediately opposite to a closely adjacent beam or wall surface, which might otherwise interfere with the desired air flow pattern.

In operation, ventilating, cooling or heating air is supplied to the closed inner space of the air injection tube 10 through the air supply conduit 12 so as to create a pressure therein above that of the ambient atmosphere. Because of the overpressure within the air injection tube 10 a high velocity air flow is directed radially outwardly from each of the air injection openings 13. In FIGS. 1 and 3 the high velocity flows of primary air have been indicated in solid black arrows 16. The high velocity flows of primary air create an underpressure by ejector effect, whereby secondary room air is forced to flow upwardly as illustrated by non-solid, "white" arrows 17 in FIG. 1. The secondary room air is mixed with the primary air of the high velocity air flows through the openings 13, whereby the primary air flows are slowed down. This allows for the velocity of the primary air flows to be as high as 15 m/sec.

Figure 4:
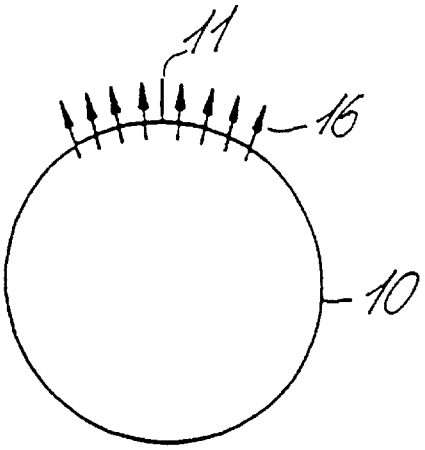

In FIG. 4, the tube 10 has the groups or patterns 15 of openings 13 arranged in a single longitudinally extending, upwardly directed zone and substantially corresponds to the embodiment shown in FIGS. 1–3. In FIG. 5, however, the tube 10 has groups or patterns 15 of openings 13 arranged in two peripherally spaced, obliquely downwardly directed zones. In the embodiment illustrated in FIG. 6, the tube 10 comprises groups or patterns 15 of openings 13 arranged in 4 longitudinally extending and upwardly directed zones which are mutually peripherally spaced. A great plurality of other arrangements of the groups or patterns of openings 13 are possible, whereby the air circulation or the air flow pattern within the room in which the tube 10 is mounted may be adjusted to specific needs.

As the air injection openings 13 are arranged in axially spaced groups or patterns 15 the flows 17 of secondary room air have flow components not only in planes extending at right angles to the longitudinal axis of the tube 10 as illustrated in FIG. 1, but also axially directed flow components as illustrated in FIG. 3. The secondary air flowing towards the air injection tube 10 between adjacent patters 15 of openings 13 is diverted axially as illustrated in FIG. 3, and thus the mixing of primary and secondary air is improved, and the high-velocity primary air flows are more efficiently slowed down.

EXAMPLE

In an injection tube as shown in the drawings each group or pattern 15 of openings 13 comprises eight axial rows of openings each comprising 32–34 openings 13. The diameter of the openings 13 is 4.5 mm, and the mutual axial spacing of the openings 13 is 19.3 mm, which means that the axial length l of each group or pattern 15 is approximately 785 mm. The mutual peripheral spacing of adjacent rows of openings is 15.5 mm, which means that the peripheral dimension of each group or pattern 15 is approximately 145 mm. The axial mutual spacing of adjacent groups or patterns 15 is approximately 215 mm. The outer diameter of the flexible tube 10 is 400 mm, and the wall thickness of the tube is 0.6 mm.

It should be understood that various modifications and amendments of the embodiments shown in the drawings could be made within the scope of the present invention. As an example, the outline of each group or pattern of openings could be circular, elliptical, hexagonal or could have any other shape than the rectangular outline shown in the drawings. It should also be mentioned that a conventional injection tube in which the injection openings are uniformly spaced along one or more longitudinal zones of the tube could be modified by using the teachings of the present invention. Thus, the uniformly spaced injection openings in each longitudinal zone could be divided into mutually axially spaced groups or patterns by covering injection openings along axially spaced transverse zones (designated d in FIG. 2), for example by means of adhesive tape or by any other suitable means.

We claim:

1. An air injection tube for injecting ventilating, cooling and/or heating air into a room in which the tub is installed, a plurality of small, mutually spaced air injecting openings being defined in the peripheral wall of the tube along at least one longitudinally extending wall zone of the tube having a cross-sectional shape defining an arc of a circle, the openings of the zone being arranged in at least two peripherally spaced rows of openings and in predetermined groups or patterns, which are mutually spaced along a length of said zone, the longitudinal spacing of adjacent groups or patterns substantially exceeding the mutual longitudinal spacing of the openings in each group or pattern of openings, the maximum angular spacing of the air injection openings in peripherally adjacent rows of each group or pattern of openings being 45° each of the groups or patterns of air injection openings being spaced from the wall surfaces defining the room, whereby primary air flow exiting through the air injection openings of the axially spaced groups or patterns of openings induces a substantial increase in secondary flow of room air directed towards the air injection tube.

2. An air injection tube according to claim 1 having a substantially circular cross-section.

3. An air injection tube according to claim 2, further comprising suspension members for suspending the air injection tube from a roof structure or ceiling of the room.

4. An air injection tube according to claim 2, wherein the peripheral spacing of peripherally adjacent rows of openings in each group or pattern does not exceed 120 mm.

5. An air injection tube according to claim 2, wherein the angular spacing of peripherally adjacent rows of openings in each group or pattern does not exceed 35°.

6. An air injection tube according to claim 2, wherein the minimum peripheral spacing of the centers of a pair of openings in peripherally adjacent rows is 10 mm.

7. An air injection tube according to claim 2, wherein the peripheral extension of each group or pattern of openings does not exceed 180°.

8. An air injection tube according to claim 2, wherein the groups or patterns are arranged in at least two longitudinally co-extending zones which are all positioned within a common longitudinally extending zone of the tube wall having a peripheral extension not exceeding 180°.

9. An air injection tube according to claim 2, wherein the peripheral extension of each group or pattern of openings is at least 32 mm.

10. An air injection tube according to claim 2, wherein each of said wall zones is defined between a pair of peripherally spaced generatrices of the outer tube wall surface.

11. An air injection tube according to claim 2, wherein the air injection openings of each group or pattern are substantially uniformly mutually spaced.

12. An air injection tube according to claim 2, wherein each pattern or group of openings comprises at least four peripherally spaced, axially extending rows of openings.

13. An air injection tube according to claim 2, wherein the air injection openings have a diameter of 2–10 mm.

14. An air injection tube according to claim 2, wherein the axial spacing of the centers of adjacent air injection openings in each pattern or group is 10–50 mm.

15. An air injection tube according to claim 2, wherein the axial extension of each group or pattern is 200–1000 mm.

16. An air injection tube according claim 15, wherein the axial extension of each group or pattern of openings is 500–800 mm.

17. An air injection tube according to claim 2, wherein the mutual longitudinal spacing of adjacent groups or patterns of openings is substantially the same along the length of the tube.

18. An air injection tube according to claim 2, wherein each group or pattern of openings is defined between a pair of peripherally spaced generatrices of the tube wall and a pair of axially spaced planes extending substantially at right angles to the tube axis, so that such group or pattern has a substantially rectangular shape when the tube wall is in an unfolded, plane condition.

19. An air injection tube according to claim 2, wherein the axial spacing of adjacent groups or patterns of openings is 20–150 percent of the axial extension of each group or pattern of openings.

20. An injection tube according to claim 19, wherein the axial spacing of adjacent groups or patterns of openings is approximately 100 percent of the axial extension of each group or pattern of openings.

21. An injection tube according to claim 2, wherein the tube wall is made from an air impervious, flexible material.

22. An injection tube according to claim 21, wherein the wall thickness of the tube is 0.2–1 mm.

23. An injection tube according to claim 2, further comprising an inner filtering member for filtering air supplied to the air injection tube.

24. An injection tube according to claim 13, wherein the air injection openings have a diameter of 4–5 mm.

25. An air injection tube according to claim 14, wherein the axial spacing of the centers of adjacent air injection openings in each pattern or group is approximately 20 mm.

26. An air injection tube according to claim 16, wherein the axial extension of each group or pattern of openings is 400–800 mm.

27. An injection tube according to claim 22, wherein the wall thickness of the tube is about 0.6 mm.

28. An air injection tube according to claim 4, wherein the angular spacing of peripherally adjacent rows of openings in each group or pattern does not exceed 35°, the minimum peripheral spacing of the centers of a pair of openings in peripherally adjacent rows being 10 mm, the peripheral extension of each group or pattern of openings not exceeding 180°, and the groups or patterns being arranged in at least two longitudinally co-extending zones which are all positioned within a common longitudinally extending zone of the tube wall having a peripheral extension not exceeding 180°.

29. An air injection tube according to claim 28, wherein the peripheral extension of each group or pattern of openings is at least 32 mm, each of said wall zones being defined between a pair of peripherally spaced generatrices of the outer tube wall surface, the air injection openings of each group or pattern being substantially uniformly mutually spaced, and each pattern or group of openings comprising at least four peripherally spaced, axially extending rows of openings.

30. An air injection tube according to claim 29, wherein the air injection openings have a diameter of 2–10 mm, the axial spacing of the centers of adjacent air injection openings in each pattern or group being 10–50 mm, the axial extension of each group or pattern being 200–1000 mm, and the axial extension of each group or pattern of openings being 500–800 mm.

31. An air injection tube according to claim 30, wherein the mutual longitudinal spacing of adjacent groups or patterns of openings is substantially the same along the length of the tube, each group or pattern of openings being defined between a pair of peripherally spaced generatrices of the tube wall and a pair of axially spaced planes extending substantially at right angles to the tube axis, so that such group or pattern has a substantially rectangular shape when the tube wall is in an unfolded, plane condition, and the axial spacing of adjacent groups or patterns of openings being 20–150 percent of the axial extension of each of group or pattern of openings.

32. A method of injecting ventilating, cooling and/or heating air into a room by means of an air injecting tube installed in a room, said tube having a plurality of small, mutually spaced injecting openings being defined in the peripheral wall of the tube along at least one longitudinally extending wall zone of the tube having a cross-sectional shape defining an arc of a circle, the openings of the zone being arranged in at least two peripherally spaced rows of openings and in groups or patterns, which are mutually spaced along the length of the zone, the longitudinal spacing of adjacent groups or patterns substantially exceeding the mutual longitudinal spacing of the openings in each group or pattern of openings, the maximum peripheral spacing of the air injection openings in peripherally adjacent rows of each group or patterns of air injection openings being spaced from the wall surfaces defining the room, said method comprising supplying air to the inner space of the tube at a pressure so as to cause air to flow out through the air injecting openings defined in the wall of the tube at a velocity of 6–15 m/sec, whereby primary air flows exciting through the maximum peripheral spacing of the air injection openings in peripherally adjacent rows of each group or patterns of air injection openings being spaced from the wall surfaces defining the room, whereby primary air flows exiting through the air injection openings of the axially spaced groups or patterns of openings induce a substantial increase in secondary flows of room air directed towards the air injection tube.

33. A method according to claim 32, wherein the air injection tube has a substantially circular cross-section shape.

34. A method to claim 33, wherein air is supplied to the inner space of the tube at a pressure so as to cause air to flow out through the air injecting openings defined in the wall of the tube at a velocity of 10–15 m/sec.

35. A method according to claim 33, wherein an air pressure of 60–200 Pa is maintained in the inner space of the tube.

36. A method according to claim 33, wherein the air flows from the injection openings are directed upwardly in the room.

37. For injecting a primary fluid into an enclosure filled with secondary fluid, a tube installed in the enclosure for substantially increasing secondary fluid flow around the tube to enhance mixing of primary and secondary fluid, said tube comprising:

a peripheral wall extending along an axis in a longitudinal direction and having a cross-sectional shape defining a circle, a plurality of fluid injection openings in said peripheral wall, said openings arranged in groups which are spaced from each other by zones without openings, each of said groups forming a pattern having openings arranged in at least four rows along the longitudinal direction and said rows being spaced along a predetermined arcual segment, so that primary fluid flow applied to the tube and exiting through said plurality of openings induces a substantial increase in secondary fluid flow whereby primary and secondary fluids are thoroughly mixed.

38. A method of mixing a primary fluid with secondary fluid in an enclosure, to obtain a thorough mixture of fluids, said method comprising:

installing a fluid injection tube in the enclosure, said tube having a plurality of small, mutually spaced injecting openings being defined in the peripheral wall of the tube along at least one longitudinally extending wall zone of the tube having a cross-sectional shape defining an arc of a circle, the openings of the zone being arranged in at least two peripherally spaced rows of openings and in groups forming patterns, which patterns are mutually spaced along the length of the zone, the longitudinal spacing of adjacent patterns substantially exceeding the mutual longitudinal spacing of the openings in each pattern of openings, the maximum peripheral spacing of the fluid injection openings in peripherally adjacent rows of each pattern being spaced from a wall surface of the enclosure, supplying primary fluid under pressure to the inner space of the tube, causing primary air flow through the injecting opening to exit at velocities between 6 and 15 m/sec, and inducing a substantial increase in secondary fluid flow around the tube, said secondary fluid flow in turn reducing the velocity of primary fluid in the vicinity of the tube.

* * * * *

UNITED STATES PATENT AND TRADEMARK OFFICE

CERTIFICATE OF CORRECTION

PATENT NO. 5,490,813

DATED February 13, 1996

INVENTOR(S) FREDE DANIELSEN et al

It is certified that error appears in the above-indentified patent and that said Letters Patent is hereby corrected as shown below:

Column 6, line 65, change "tub" to --tube--.

Column 9, line 30, change "cross-section" to --cross sectional--.

Signed and Sealed this

Thirtieth Day of July, 1996

*Attest:*

*Attesting Officer*

BRUCE LEHMAN

*Commissioner of Patents and Trademarks*